United States Patent [19]

Althaus

[11] Patent Number: 5,001,832

[45] Date of Patent: Mar. 26, 1991

[54] RAZOR BLADE UNIT

[75] Inventor: Wolfgang Althaus, Wuppertal, Fed. Rep. of Germany

[73] Assignee: Wilkinson Sword GmbH, Soligen, Fed. Rep. of Germany

[21] Appl. No.: 235,949

[22] Filed: Aug. 24, 1988

[30] Foreign Application Priority Data

Aug. 25, 1987 [DE] Fed. Rep. of Germany ... 8711505[U]

[51] Int. Cl.[5] ..... B26B 21/14

[52] U.S. Cl. ..... 30/77; 30/50

[58] Field of Search ..... 30/34 R, 77, 90, 83, 30/84, 48–50, 81, 82

[56] References Cited

U.S. PATENT DOCUMENTS

| | | | |
|---|---|---|---|
| 1,860,680 | 5/1932 | Lucke | 30/83 X |
| 2,068,085 | 1/1937 | Stanley | 30/34 |
| 2,083,580 | 6/1937 | Schmitt | 30/90 X |
| 2,198,531 | 4/1940 | Fulenwider | 30/90 X |
| 2,300,794 | 11/1942 | Martin | 30/83 X |
| 4,378,633 | 4/1983 | Jacobson | 30/47 |
| 4,502,217 | 3/1985 | Schächter | 30/82 |
| 4,562,644 | 1/1986 | Hitchens | 30/77 X |
| 4,683,096 | 7/1987 | Ferraro | 30/90 X |

FOREIGN PATENT DOCUMENTS

PCT/US85/-01903 4/1986 PCT Int'l Appl. .

*Primary Examiner*—Douglas D. Watts
*Assistant Examiner*—Hwei-Siu Payer
*Attorney, Agent, or Firm*—Finnegan, Henderson, Farabow, Garrett & Dunner

[57] ABSTRACT

A razor blade unit includes a plastic support member having a guide surface and a top cap. At least one razor blade having a cutting edge is embedded in the support member. At least one freely rotatable cylindrical roller is attached axially to the support member and extends parallel to the cutting edge of the razor blade to engage a skin area. A cylindrical roller has a lower coefficient of friction than the plastic support member. The cylindrical roller was preferably made of metal and is located in the guide surface and/or in the top cap of the razor blade unit.

4 Claims, 2 Drawing Sheets

RAZOR BLADE UNIT

BACKGROUND OF THE INVENTION

1. Field of the Invention

The invention concerns a razor blade unit for a safety razor, where a razor blade or two razor blades parallel to each other are embedded in a plastic part. The plastic part has a guide surface parallel to the cutting edges of the razor blades in front of the razor blades in the direction of shaving. It also has a top cap behind the razor blades in the direction of shaving. The razor blade unit is fitted with a device for reducing the friction of the plastic part when shaving.

2. Description of the Related Art

Known razor blade units for wet safety razors have a plastic part in which a razor blade or twin razor blade is embedded. In the case of the twin razor blade, two razor blades are embedded in the plastic part parallel to each other and with cutting edges offset from each other. The plastic part has a guide surface parallel to the cutting edges of the razor blades, in front of the razor blades in the direction of shaving. The plastic part of the known razor blade unit also has a top cap which is arranged behind the razor blades in the direction of shaving and covers the razor blades behind their cutting edges.

During the shaving process, the razor blade unit is moved over the skin. As this is done, pressure exerted on the safety razor by the user is transmitted to the skin by the surface of the razor blade unit. Even smaller razor blade units have further increased the specific pressure loads. Razor blade units made of plastic have the disadvantage of a high coefficient of friction greater than 0.3. Plastics, because of their polar nature tend to increase this coefficient of friction even further when wet. It is true that a shaving aid, for example foam or soap, reduces friction. However, studies have shown that the shaving process consists of micro-movements and in the first movement over a surface the shaving aid is pushed away so that all further movements are then made without any shaving aid.

One attempt to counter this disadvantage uses a piece of sponge, impregnated with water-soluble plastic, on the protective cap. This arrangement leaves behind a polymeric shaving aid on the skin. A disadvantage is that the effect of this shaving aid only occurs if the razor blade unit is frequently rinsed with water during the shaving process in order to dissolve the shaving aid out of the sponge. Another disadvantage is that sticky residues are left on the skin.

SUMMARY OF THE INVENTION

It is an object of the present invention to reduce the friction between the razor blade unit and the skin in a simple way that is reliable for the entire duration of the shaving process.

The present invention reduces the friction by using a strip running parallel to the cutting edges of the razor blades with a lower coefficient of friction than the plastic part.

Such razor blade unit has the advantage that the frictional forces between the razor blade unit and the user's skin are reduced by means of a device that works purely mechanically.

Since the device works purely on a mechanical basis, the strips, with their lower coefficient of friction, ensure that the lower friction between the razor blade unit and skin is maintained throughout the shaving process. The strips are then arranged at those places in or on the plastic part of the razor blade unit at which the frictional forces act in the shaving process.

The strip preferably consists of metal. Metals have, in contact with the skin, a coefficient of friction of less than 0.1, both when dry and when wet. With such metal strips the friction between the razor blade unit and the skin is reduced considerably.

The strip is preferably configured as a cylindrical roller which can, in addition, be mounted to turn freely around an axis parallel to the cutting edges of the razor blades. In this way the friction is even further reduced.

Instead of using a rotatable cylindrical roller, the strip, in an alternative form, also can be arranged rigidly in the plastic part.

In one embodiment, the strip can be arranged in the plastic part in front of the razor blades in the direction of shaving in place of the guide surface. This arrangement has the advantage of greatly reducing the strong frictional forces occuring at the guide surface of the razor blade unit.

In another embodiment the strip can be arranged in the top cap behind the razor blades in the direction of shaving with a slight projection from the top cap. Relatively large frictional forces occurring in the top cap of the razor blade unit can be reduced by the arrangement of the strip in this position.

The two forms of execution just described can also be combined, so that strips are positioned both before and after the razor blades in the plastic part so that frictional forces are reduced by the strips at all possible places where they act.

Additional objects and advantages of the invention will be set forth in the description that follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DESCRIPTION OF THE PREFERRED EMBODIMENT

Reference will now be made in detail to the present preferred embodiments of the invention as illustrated in the accompanying drawings.

Figure 1:
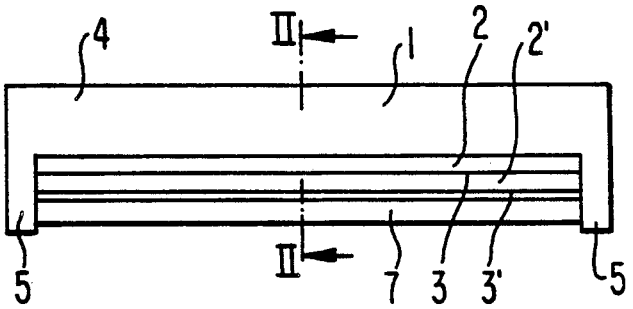
FIG. 1 is a front view of a razor blade unit, where a cylindrical roller is arranged in front of the razor blades to reduce friction incorporating the teachings of the present invention.
Figure 2:
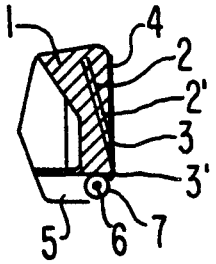
FIG. 2 is a section view along line II—II in FIG. 1.

The first embodiment of a razor blade unit for a wet safety razor in accordance with the present invention is shown in FIGS. 1 and 2. It includes a support member such as a plastic part 1, in which two razor blades 2,2' are embedded in the form of a twin razor blade, the cutting edges 3,3' of the razor blades 2,2' being arranged offset behind each other. The surfaces of the razor blades 2,2' lying behind the cutting edges 3,3' are covered by a top cap 4 of the plastic part 1.

A strip such as a metal roller 7 is mounted between the ends 5 of the plastic part 1 to turn freely on an axis 6 in front of the cutting edges 3,3' of the razor blades 2,2' in the direction of shaving. This metal roller 7 has, in contact with the skin, a considerably lower coefficient of friction compared to the plastic of the plastic part 1, both when dry and when wet. The metal roller 7 in this embodiment is arranged where the razor blade unit normally has a guide surface, so as to reduce the frictional forces in this area.

Figure 3:
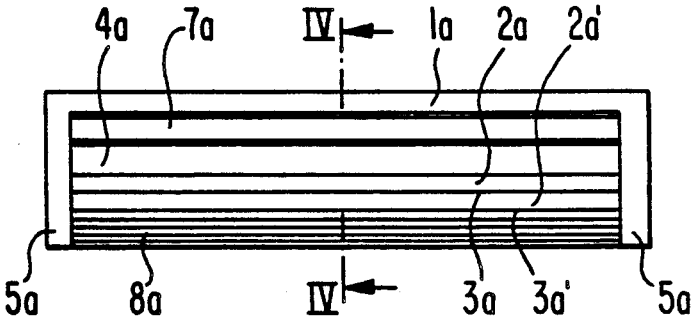
FIG. 3 is a front view of a second form of execution of the razor blade unit, where a cylindrical roller is arranged in the top cap, incorporating the teachings of the present invention.
Figure 4:
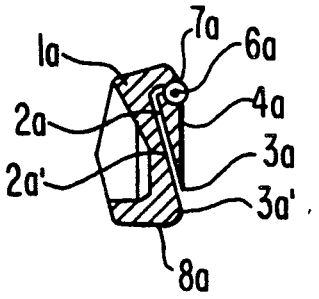
FIG. 4 is a section view along line IV—IV in FIG. 3.

The second embodiment is shown in FIGS. 3 and 4 and differs from the first in two ways. First, there is a tranverse guide surface **8*a* in front of the razor blades 2*a*,2*a*' which is formed as one piece with the plastic part 1*a*. Secondly, the strip in the form of the metal roller 7*a* is mounted to turn freely in top cap 4*a* around axis 6*a*. The metal roller projects slightly beyond the top cap 4*a*. When shaving, relatively large frictional forces also act in the area of this top cap 4*a*. These are reduced by the metal roller 7*a***.

Figure 5:
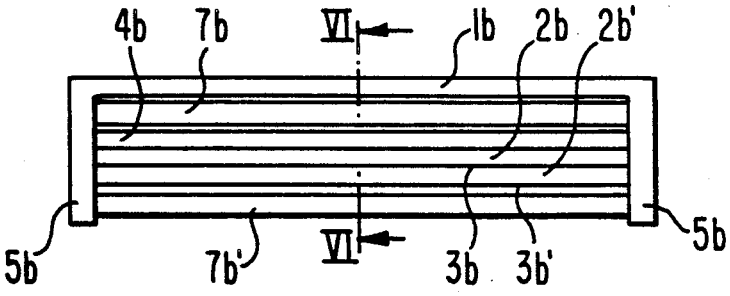
FIG. 5 is a front view of a third form of execution of the razor blade unit, where a cylindrical roller is arranged in front of the razor blades in the manner shown in FIGS. 1 and 2, and in which a cylindrical roller is arranged in the top cap as shown in FIGS. 3 and 4, incorporating the teachings of the present invention.
Figure 6:
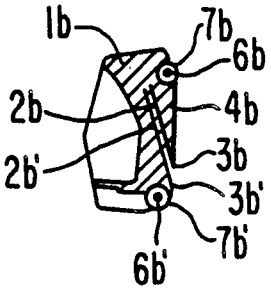
FIG. 6 is a section view along line VI—VI in FIG. 5.

The third embodiment is shown in FIGS. 5 and 6. This embodiment illustrates that the first and second embodiments also can be combined with each other so that a metal roller **7*b*' is arranged in front of the razor blades 2*a*,2*a*' in the area of the otherwise usual guide surface and another metal roller 7*b* is arranged behind the razor blades 2*b*,2*b*' in the top cap 4*b***. This assures that the frictional forces are reduced by the metal rollers at those points where they occur most strongly. With an appropriate arrangement of the rollers, spacing of the rollers, diameter and position on the top cap, the skin can be tautented or guided in a controlled fashion to reduce skin irritations and increase shaving performance.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concepts as defined by the appended claims and their equivalents.

What is claimed is:

1. A razor blade unit having first and second sides opposite to each other, the razor blade unit comprising:

a plastic support member having a stationary plastic surface for engaging the skin on the first side of the razor blade unit;

at least one razor blade secured to the plastic support member and having a cutting edge extending from the plastic support member between the first and second sides;

at least one freely rotatable cylindrical metal roller attached axially to the plastic support member and extending parallel to the cutting edge of said at least one razor blade on the second side of the razor blade unit, said metal roller having a lower coefficient of friction against the skin area than the stationary plastic surface of the support member.

2. A razor blade unit as set forth in claim 1 wherein said at least one cylindrical roller includes a cylindrical roller located in the stationary plastic surface in front of the razor blade in the direction of shaving.

3. A razor blade unit for movement across a skin area in a shaving direction, the razor blade unit comprising:

a plastic support member having a stationary guide surface;

at least one razor blade embedded in said support member and having a cutting edge extending parallel to said guide surface, said guide surface being disposed to contact the skin area ahead of the razor blade when the razor blade unit is moved in the shaving direction;

a protective cap disposed on said support member, said protective cap being arranged on a side of said cutting edge opposite said guide surface; and a cylindrical metal roller rotatably supported on said protective cap and projecting therefrom, said cylindrical metal roller extending parallel to the edge of the razor blade and being arranged to contact the skin area after the guide surface and the razor blade contact the skin area when the razor blade unit is moved in the shaving direction across the skin area.

4. A razor blade unit as set forth in claim 3 wherein the roller is arranged rigidly in the support member.

* * * * *